US007793657B1

(12) United States Patent
Sandusky

(10) Patent No.: US 7,793,657 B1
(45) Date of Patent: Sep. 14, 2010

(54) FACEMASK SNORKEL

(76) Inventor: Wayne Sandusky, 10606 W. Laughery Creek Rd., Dillsboro, IN (US) 47018

( * ) Notice: Subject to any disclaimer, the term of this patent is extended or adjusted under 35 U.S.C. 154(b) by 739 days.

(21) Appl. No.: 11/694,964

(22) Filed: Mar. 31, 2007

(51) Int. Cl.
*A61M 11/00* (2006.01)

(52) U.S. Cl. ..... 128/201.11; 128/201.19

(58) Field of Classification Search ..... 128/201.11, 128/201.19, 201.27, 200.29, 201.28, 205.24
See application file for complete search history.

(56) References Cited

U.S. PATENT DOCUMENTS 3,860,042 A * 1/1975 Green ..... 128/201.11
4,610,246 A * 9/1986 Delphia ..... 128/201.11
4,805,610 A * 2/1989 Hunt ..... 128/201.11
5,906,199 A * 5/1999 Budzinski ..... 128/201.11
6,253,763 B1 * 7/2001 Pounders, Jr. ..... 128/201.11
2001/0013346 A1 * 8/2001 Lemke ..... 128/201.11
2007/0186926 A1 * 8/2007 Morgan et al. ..... 128/201.27

* cited by examiner

*Primary Examiner*—Steven O Douglas

(57) ABSTRACT

A facemask snorkel is disclosed. An illustrative embodiment of the facemask snorkel includes a facemask having a facemask interior, a snorkel disposed in pneumatic communication with the facemask interior and a resilient mouth seal disposed in pneumatic communication with the facemask interior.

7 Claims, 5 Drawing Sheets

FACEMASK SNORKEL

FIELD

The present invention relates to swimming accessories. More particularly, the present invention relates to a facemask snorkel which enables a user to speak during snorkeling.

BACKGROUND

A typical conventional snorkel includes a "J"-shaped tube fitted with a mouthpiece on the lower end. The mouthpiece fits in the user's mouth and forms a seal with the user's lips. However, conventional snorkels typically do not enable a user to speak while the mouthpiece is in the user's mouth.

SUMMARY

The present invention is generally directed to a facemask snorkel. An illustrative embodiment of the facemask snorkel includes a facemask having a facemask interior, a snorkel disposed in pneumatic communication with the facemask interior and a resilient mouth seal disposed in pneumatic communication with the facemask interior.

BRIEF DESCRIPTION OF THE DRAWINGS

The invention will now be described, by way of example, with reference to the accompanying drawings, in which.

DETAILED DESCRIPTION

Figure 1:
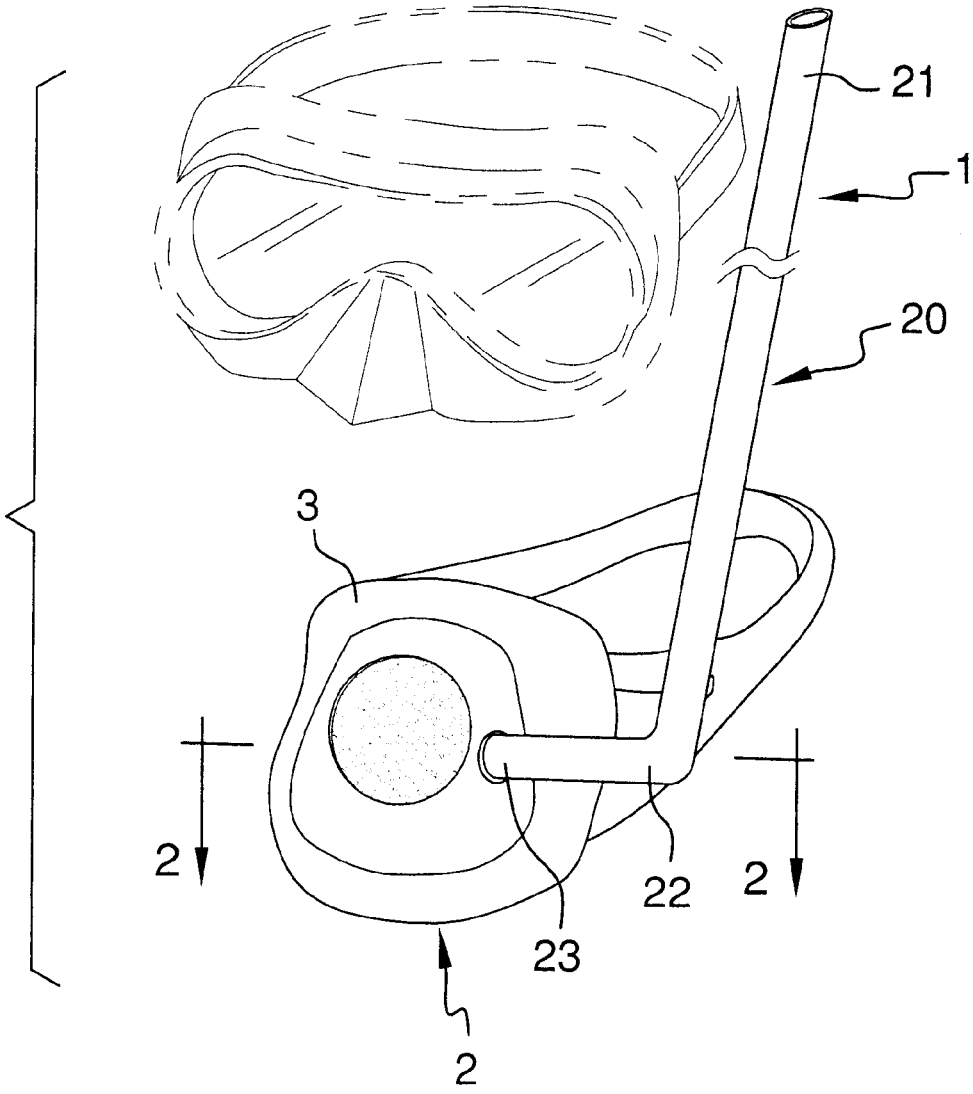
FIG. 1 is a perspective view of an illustrative embodiment of the facemask snorkel.
Figure 2:
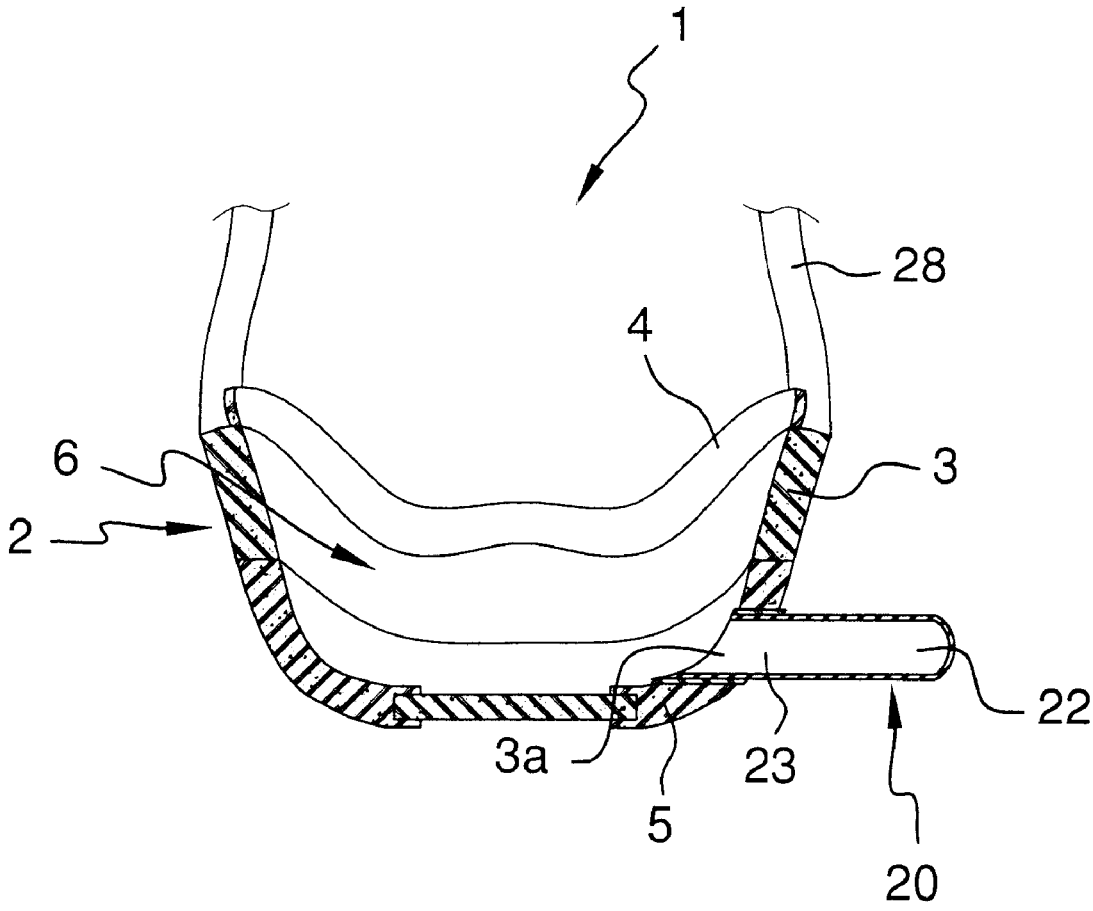
FIG. 2 is a sectional view, taken along section lines 2-2 in FIG. 1, of the facemask element and a portion of the snorkel element of the facemask snorkel.
Figure 3:
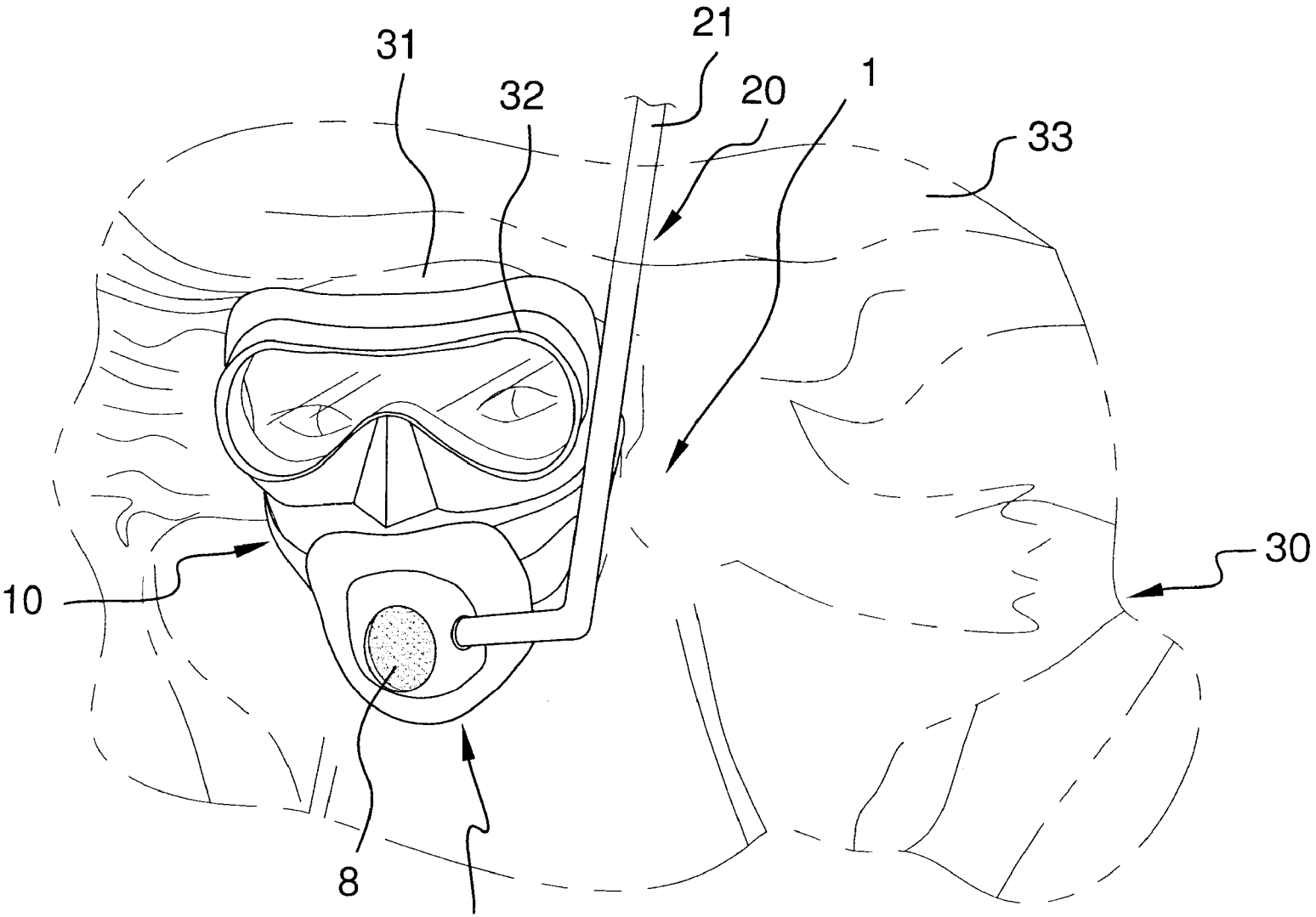
FIG. 3 is a front perspective view, partially in section, of an illustrative embodiment of the facemask snorkel, being worn by a user during swimming.
Figure 4:
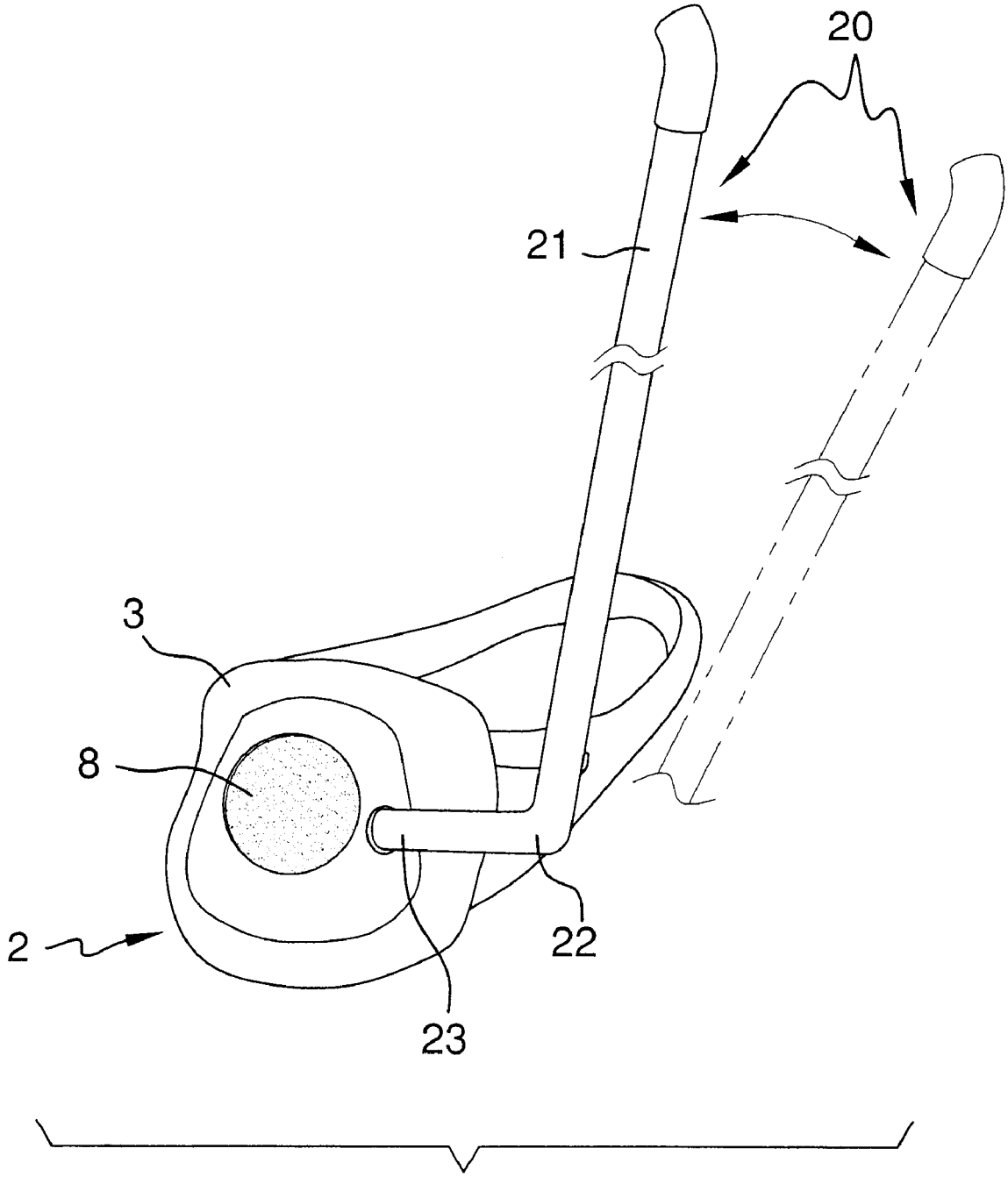
FIG. 4 illustrates the movement of the snorkel tube.

Referring initially to FIGS. 1-3 of the drawings, an illustrative embodiment of the facemask snorkel 1 is generally indicated by reference numeral 1. The facemask snorkel 1 includes a facemask 2 which may be rubber or plastic, for example. The facemask 2 typically includes a side wall 3, which may be continuous. A seal wall 4 (FIG. 2) and an end wall 5 extend from the side wall 3 in spaced-apart relationship to each other. As shown in FIG. 2, the side wall 3, seal wall 4 and end wall 5 together define a facemask interior 6.

As shown in FIG. 2, a snorkel opening 3*a* extends through the side wall 3 of the facemask 2. A snorkel 20, which may be rubber or plastic, for example, is disposed in pneumatic communication with the facemask interior 6 through the snorkel opening 3*a*. The snorkel 20 may include, for example, an elongated main portion 21; a bend 22 which extends from the main portion 21; and an attachment portion 23 which extends from the bend 22 and communicates with the facemask interior 6. The attachment portion 23 of the snorkel 20 may be attached to the side wall 3 of the facemask 2 using any suitable technique which is known to those skilled in the art.

The seal wall 4 is adapted to form a fluid-tight seal with the face of a swimmer 30, as shown in FIG. 3, during use of the facemask snorkel 1 which will be hereinafter described. A strap 28, which is typically rubber, may be provided on the facemask 2 to facilitate attachment of the facemask 2 to the head 31 of the swimmer 30.

Referring next to FIG. 3 of the drawings, in typical use of the facemask snorkel 1, the facemask 2 is attached to the head 31 of a swimmer 30 typically by extending the strap 28 around the swimmer's head 31. Accordingly, the facemask 10 is positioned such that the chin portion engages the swimmer's chin; the face portions engage the swimmer's face; and the nose portion engages the swimmer's nose in a fluid-tight seal. The swimmer 30 typically also wears goggles 32, which may be conventional. As the swimmer 30 swims in a body of water 33, with his or her head partially or completely submerged in the water 33, the main portion 21 of the snorkel 20 protrudes beyond the surface of the water 33. Accordingly, as the swimmer 30 inhales, air is drawn through the snorkel 20, into the facemask interior 6 and into the swimmer's mouth, respectively. As the swimmer 30 exhales, the air is discharged from the snorkel 20 through the opposite path. It will be appreciated by those skilled in the art that the diaphragm 8 permits movement of the swimmer's mouth to facilitate talking of the swimmer 30 into the facemask 2 typically when the swimmer's head 31 is raised out of the water 33. This prevents the swimmer 30 from removing the facemask 2 from his or her face each time he or she wishes to communicate.

Figure 5:
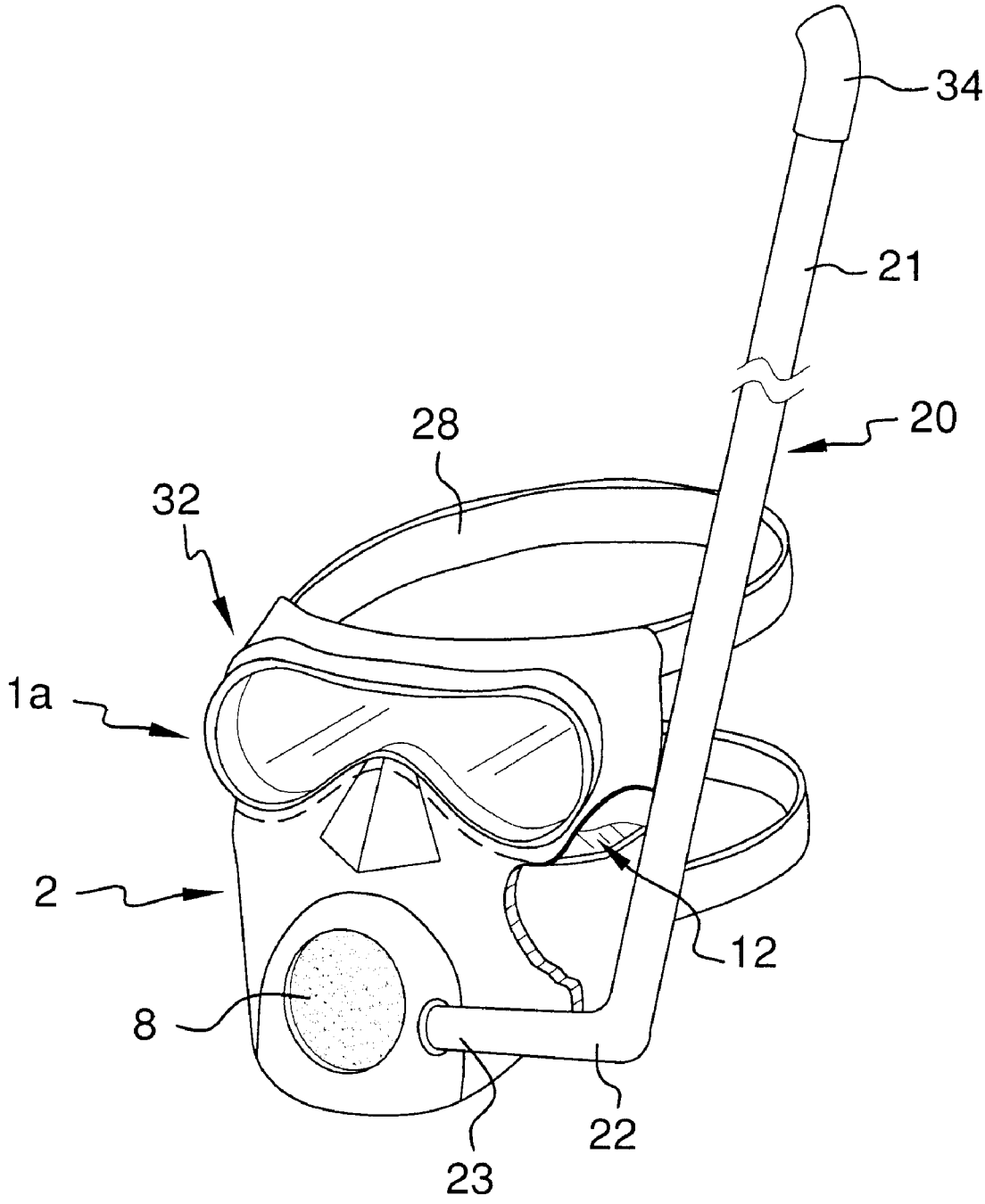
FIG. 5 is a perspective view of an illustrative alternative embodiment of the facemask snorkel.

An alternative embodiment of the facemask snorkel 1*a* is shown in FIG. 5. The facemask snorkel 1*a* is similar in design to the facemask snorkel 1 but further include goggle 32 which was heretofore described except the goggle 32 is formed in one piece with respect to the facemask 2 of the facemask snorkel 1*a*. A divider 12 is further provided to prevent fogging of the interior of the goggle 32. Moreover, a dry valve 34 may be provided in the snorkel 20, such as in the distal end of the main portion 21 of the snorkel 20, for example, to prevent water from entering the snorkel 20 and passing into the facemask 2.

While the preferred embodiments of the invention have been described above, it will be recognized and understood that various modifications can be made in the invention and the appended claims are intended to cover all such modifications which may fall within the spirit and scope of the invention.

What is claimed is:

1. A facemask snorkel, comprising:

a facemask having a facemask interior;

a snorkel disposed in pneumatic communication with said facemask interior; and a resilient mouth seal disposed in pneumatic communication with said facemask interior, said mouth seal having a diaphragm for allowing verbal communication by the user when the user's head is raised out of water wherein said mouth seal and said diaphragm cooperate to define said facemask interior.

2. The facemask snorkel of claim 1 further comprising a strap carried by said facemask.

3. The facemask snorkel of claim 1 further comprising a dry valve provided in said snorkel.

4. The facemask snorkel of claim 1 wherein said snorkel is pivotally attached to said facemask.

5. The facemask snorkel of claim 1 wherein said snorkel comprises an attachment portion carried by said facemask, a bend extending from said attachment portion and an elongated main portion extending from said bend.

6. The facemask snorkel of claim 5 further comprising a snorkel opening provided in said facemask and wherein said attachment portion of said snorkel extends through said snorkel opening.

7. The facemask snorkel of claim 6 further comprising a snorkel seal provided in said snorkel opening between said facemask and said attachment portion of said snorkel.

* * * * *